US010608370B2

(12) United States Patent
Takeuchi et al.

(10) Patent No.: US 10,608,370 B2
(45) Date of Patent: Mar. 31, 2020

(54) WIRE WITH A CORE, A TERMINAL WITH BARRELS CRIMPED TO THE CORE AND A MOLDED PORTION COVERING THE BARRELS AND THE CORE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shunya Takeuchi, Mie (JP); Yasuo Omori, Mie (JP); Hajime Matsui, Mie (JP); Takehiro Nakata, Mie (JP); Yoshiaki Yamano, Mie (JP); Tetsuya Nakamura, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/767,233

(22) PCT Filed: Oct. 3, 2016

(86) PCT No.: PCT/JP2016/079364
§ 371 (c)(1),
(2) Date: Apr. 10, 2018

(87) PCT Pub. No.: WO2017/065043
PCT Pub. Date: Apr. 20, 2017

(65) Prior Publication Data

US 2019/0074629 A1 Mar. 7, 2019

(30) Foreign Application Priority Data

Oct. 12, 2015 (JP) ..... 2015-201648

(51) Int. Cl.
*H01R 4/04* (2006.01)
*H01R 13/52* (2006.01)
(Continued)

(52) U.S. Cl.
CPC ..... *H01R 13/5216* (2013.01); *H01R 4/185* (2013.01); *H01R 4/70* (2013.01);
(Continued)

(58) Field of Classification Search
CPC ..... H01R 4/024; H01R 43/02; H01R 4/187
(Continued)

(56) References Cited

U.S. PATENT DOCUMENTS 3,673,549 A * 6/1972 Bliley ..... H01R 4/20 439/730
4,169,271 A * 9/1979 Saitoh ..... H01L 23/3107 257/529
(Continued)

FOREIGN PATENT DOCUMENTS

JP 2012003856 * 1/2005 ..... H01R 13/52
JP 2012-3856 1/2012
(Continued)

OTHER PUBLICATIONS

International Search Report dated Dec. 13, 2016.

*Primary Examiner* — Abdullah A Riyami
*Assistant Examiner* — Thang H Nguyen
(74) *Attorney, Agent, or Firm* — Gerald E. Hespos; Michael J. Porco; Matthew T. Hespos

(57) ABSTRACT

A wire with terminal, (10) includes a barrel (23) formed in a rear end part of a terminal fitting (15) such that two crimping pieces (27) extend from both widthwise side edges of a base plate (24) and crimped to surround an exposed area (14) of a core (12) with extending end parts (27E) of the crimping pieces (27) held close to each other, and a mold
(Continued)

(30) covering the entire exposed area of the core (12) including a crimped part to the barrel (23) in a liquid-tight manner. A front end of the core (12) is disposed behind those of the crimping pieces (27). The barrel (23) is formed with a communicating portion (29) for causing a crimping space (28) of the barrel (23) to be open in an outer peripheral surface of the barrel (23) on a side before the front end of the core (12).

2 Claims, 9 Drawing Sheets

(51) Int. Cl.
*H01R 4/72* (2006.01)
*H01R 4/70* (2006.01)
*H01R 4/18* (2006.01)
*H01R 4/62* (2006.01)

(52) U.S. Cl.
CPC ..... *H01R 4/184* (2013.01); *H01R 4/62* (2013.01); *H01R 13/52* (2013.01)

(58) Field of Classification Search
USPC ..... 439/874, 932, 730, 523
See application file for complete search history.

(56) References Cited

U.S. PATENT DOCUMENTS

| | | | | |
|---|---|---|---|---|
| 4,310,719 | A * | 1/1982 | Cross | H01R 4/029 174/94 R |
| 8,864,533 | B2 * | 10/2014 | Morikawa | H01R 4/62 439/595 |
| 2013/0225014 | A1 * | 8/2013 | Sato | H01R 4/70 439/736 |
| 2013/0252459 | A1 * | 9/2013 | Tanaka | H01R 4/185 439/523 |
| 2015/0140856 | A1 * | 5/2015 | Sato | H01R 4/70 439/523 |
| 2015/0140857 | A1 * | 5/2015 | Sato | H01R 4/185 439/523 |
| 2016/0006164 | A1 * | 1/2016 | Sato | H01R 4/185 439/587 |
| 2016/0359245 | A1 * | 12/2016 | Aoki | H01R 4/185 |
| 2017/0331202 | A1 | 11/2017 | Aoki et al. | |

FOREIGN PATENT DOCUMENTS

| | | |
|---|---|---|
| JP | 2014-29793 | 2/2014 |
| JP | 2014-182957 | 9/2014 |
| JP | 2015-179635 | 10/2015 |
| WO | 2012/049948 | 4/2012 |

* cited by examiner

WIRE WITH A CORE, A TERMINAL WITH BARRELS CRIMPED TO THE CORE AND A MOLDED PORTION COVERING THE BARRELS AND THE CORE

BACKGROUND

Field of the Invention

The invention relates to a wire with terminal.

Description of the Related Art

Japanese Unexamined Patent Publication No. 2012-003856 discloses a technique for anti-corrosion by crimping and connecting a barrel of a terminal fitting made of copper to a front end part of a coated wire, in which a core made of aluminum is surrounded by an insulated coating, and surrounding a contact part of the core and the terminal fitting in a liquid-tight manner by a mold made of synthetic resin. The mold covers up to a front end part of the insulation coating behind the terminal fitting.

The barrel to be crimped to the coated wire includes a base plate portion and two crimping pieces extending from both widthwise sides of the base plate. In a crimped state, the crimping pieces are wound on the outer periphery of the coated wire by bringing extending ends thereof toward each other. Thus, if the front end of the coated wire is located at a position behind the front ends of the crimping pieces, the front end surface of the core needs to be covered with the mold by causing molten resin to flow into a crimping space of the barrel without leaving any clearance in a molding process of the mold. However, since an opening on the front end of the crimping space of the barrel is narrow, there is a problem that the molten resin is difficult to flow into the crimping space.

The invention was completed on the basis of the above situation and aims to make molten resin easily flow into a barrel.

SUMMARY

The invention is directed to a wire with terminal that has a coated wire including a core and an insulation coating surrounding the core, and with the core being exposed in a front end part. The wire with terminal also includes a terminal fitting. A barrel is formed in a rear end part of the terminal fitting such that two crimping pieces extend from both widthwise sides of a base plate. The barrel is crimped to surround an exposed area of the core with extending end parts of the crimping pieces held close to each other. A mold covers the entire exposed area of the core including a crimped part to the barrel in a liquid-tight manner. A front end of the core is disposed behind those of the crimping pieces. The barrel is formed with a communicating portion for causing a crimping space of the barrel to be open in an outer peripheral surface of the barrel on a side before the front end of the core.

The barrel is formed with the communicating portion. Thus, molten resin easily flows into the crimping space of the barrel by passing through the communicating portion when the mold is molded.

The communicating portion may be formed between the extending end parts of the crimping pieces. According to this configuration, the strength of the base plate need not be reduced.

The barrel may be crimped to surround the exposed area of the core without contacting the insulation coating, the mold may cover the entire exposed area of the core including the crimped part to the barrel and a front end part of the insulation coating in a liquid-tight manner, and the entire terminal fitting and only an area of the mold before a front end of the insulation coating may be accommodated in the terminal accommodation chamber formed in the housing. According to this configuration, an insulation barrel to be crimped to the insulation coating is not formed in the rear end part of the terminal fitting. Thus, an area of the mold surrounding the terminal fitting can be accommodated into the terminal accommodation chamber even without enlarging the volume of the terminal accommodation chamber.

DETAILED DESCRIPTION

Figure 1:
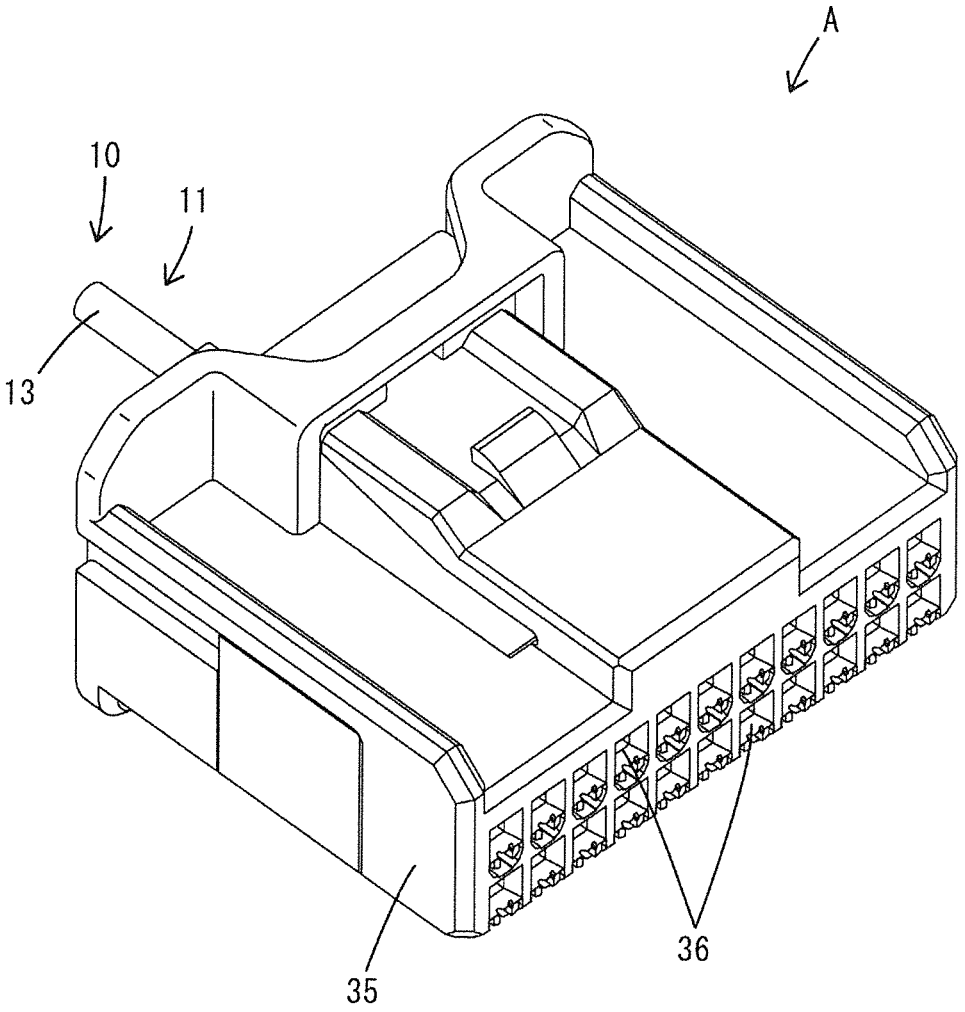
FIG. 1 is a perspective view of a connector of an embodiment.
Figure 2:
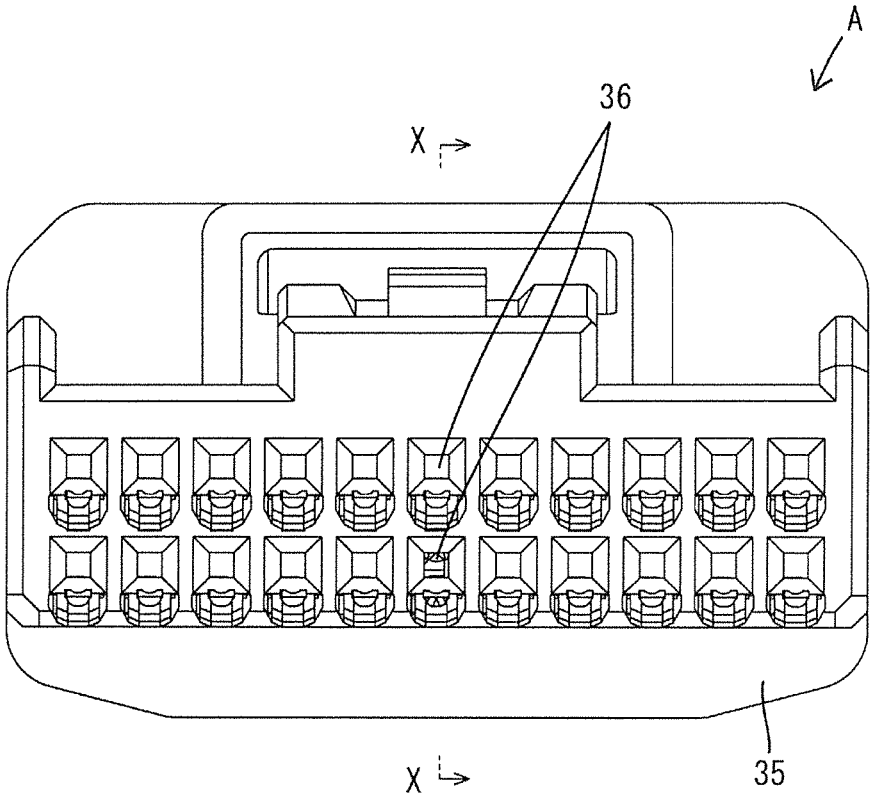
FIG. 2 is a front view of the connector.
Figure 3:
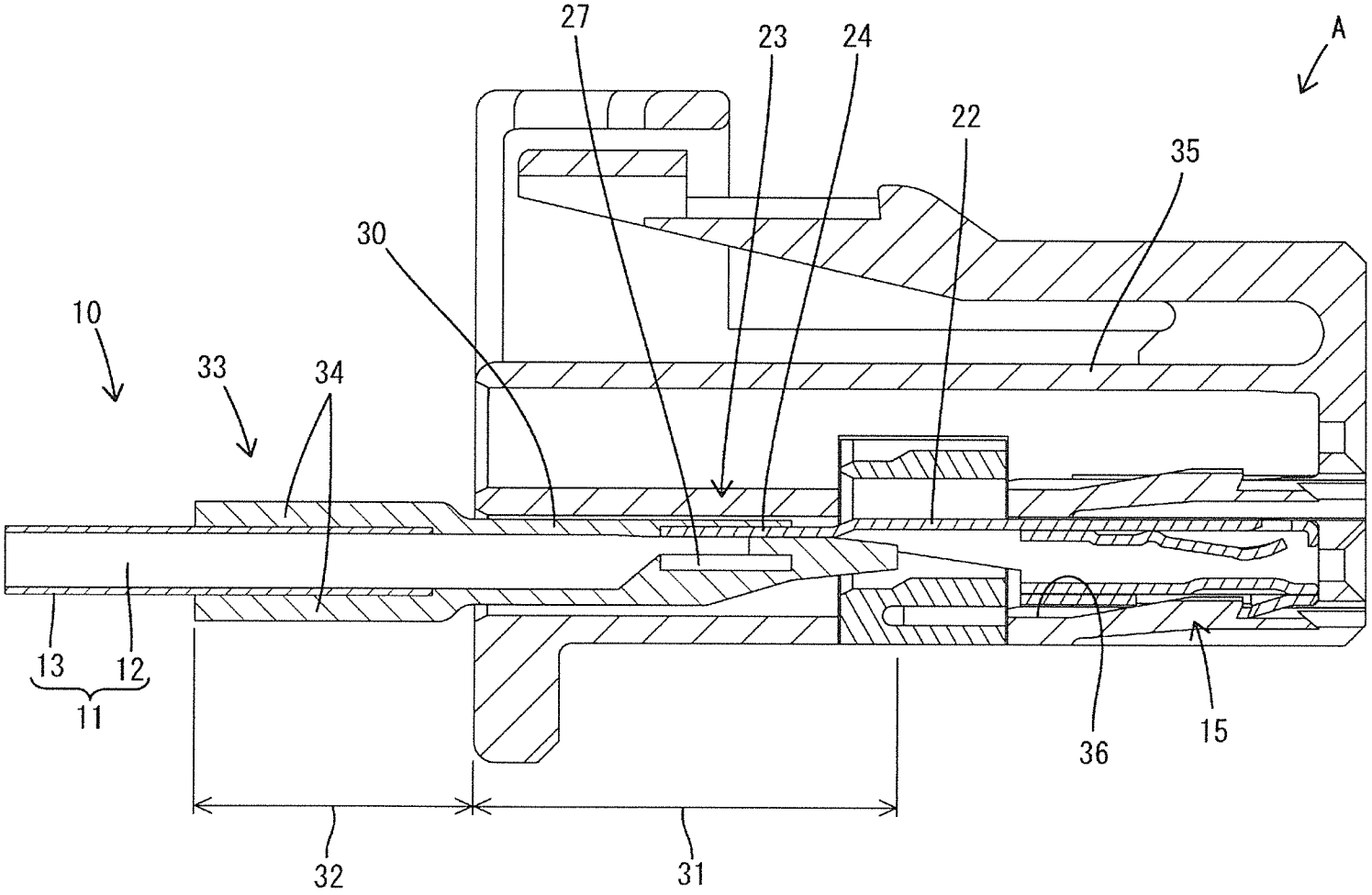
FIG. 3 is a section along X-X of FIG. 2.
Figure 4:
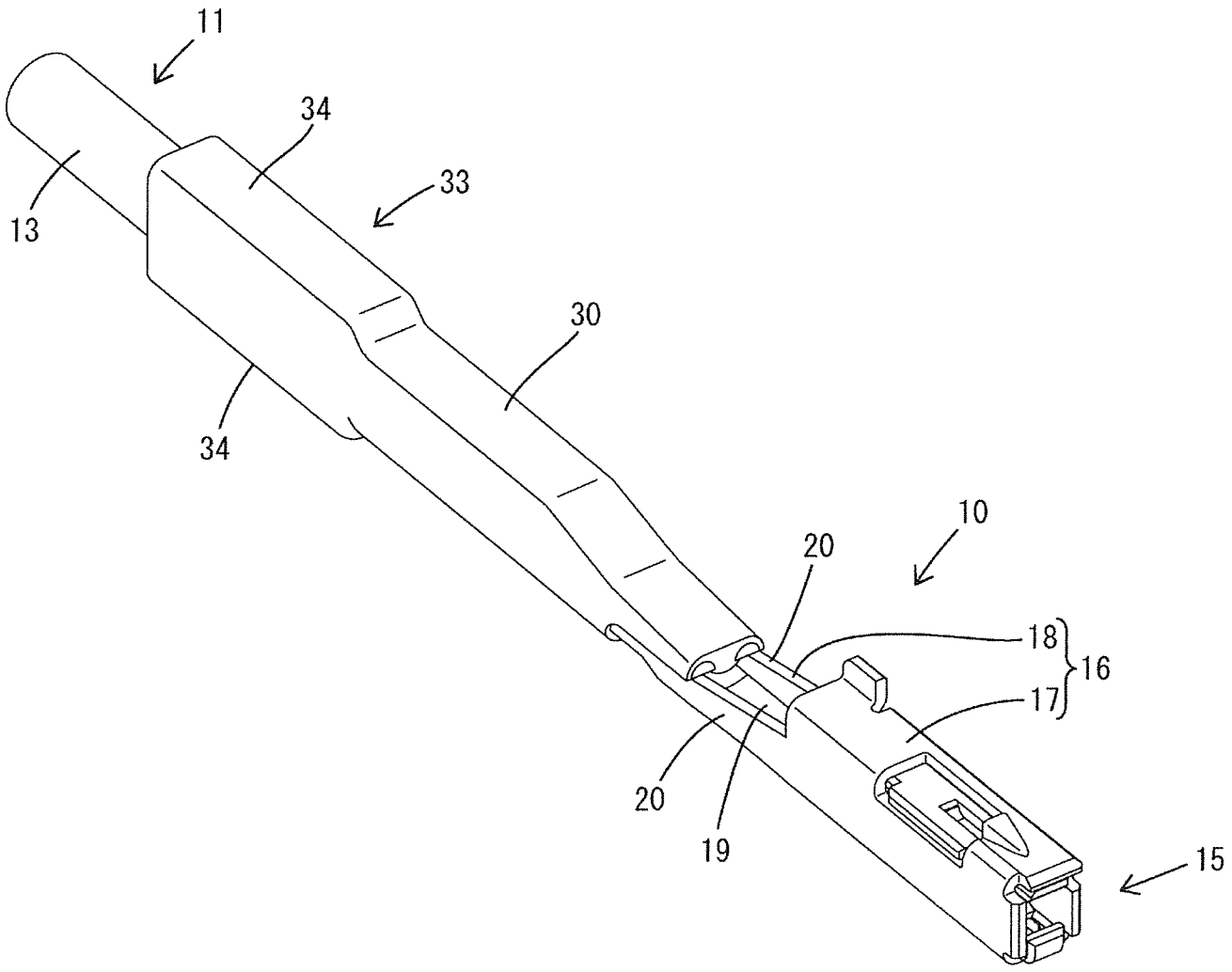
FIG. 4 is a perspective view of a wire with terminal.
Figure 5:
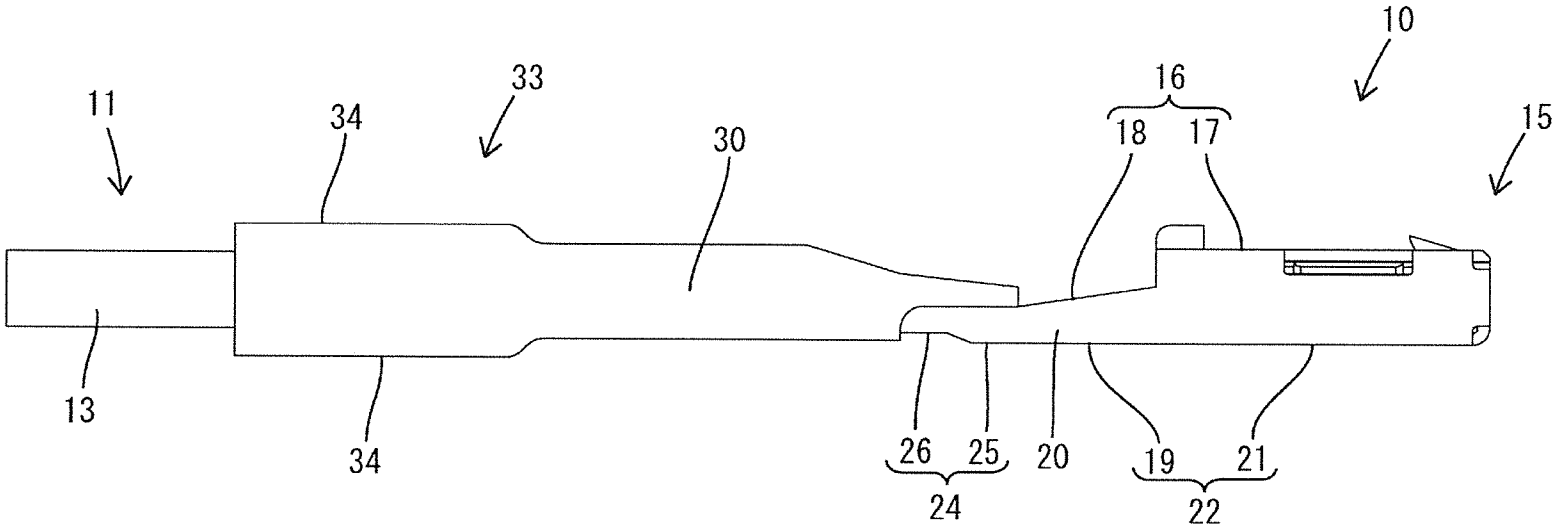
FIG. 5 is a side view of the wire with terminal.
Figure 6:
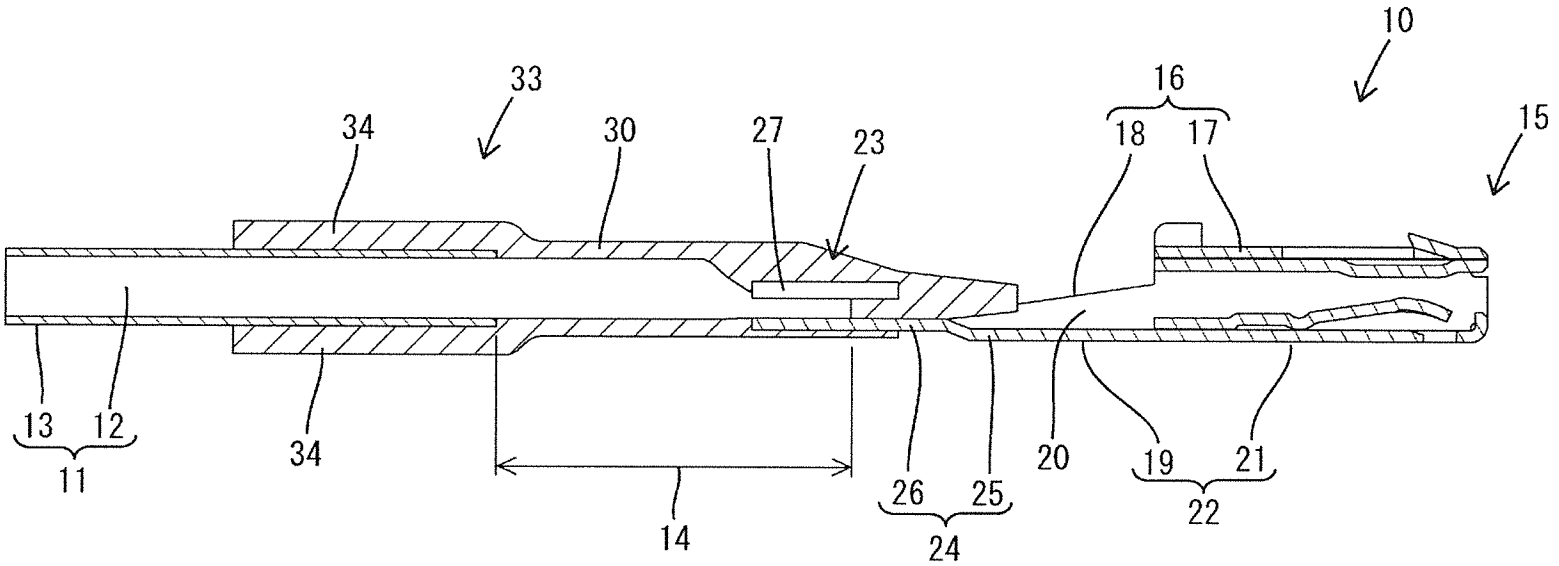
FIG. 6 is a section of the wire with terminal.

Hereinafter, a specific embodiment of the invention is described with reference to FIGS. 1 to 9. Note that, in the following description, a right side in FIGS. 3, 5 and 6 is defined as a front side concerning a front-rear direction. Upper and lower sides shown in FIGS. 2, 3, 5 and 6 are directly defined as upper and lower sides concerning a vertical direction. A connector A of this embodiment includes wires with terminals 10 and a housing 35.

The wire with terminal 10 is an integral assembly of a coated wire 11, a terminal fitting 15 and a mold 30 and constitutes a conductive path long and narrow in the front-rear direction. The coated wire 11 is composed of a core 12 made of aluminum or aluminum alloy and a substantially hollow cylindrical insulation coating 13 surrounding the core 12. The insulation coating 13 is stripped by a predetermined length in a front end part of the coated wire 11 to expose the core 12. The terminal fitting 15 to be described later is crimped and connected to a front end part of an exposed area 14 (see FIGS. 6 and 8) of this core 12.

Figure 7:
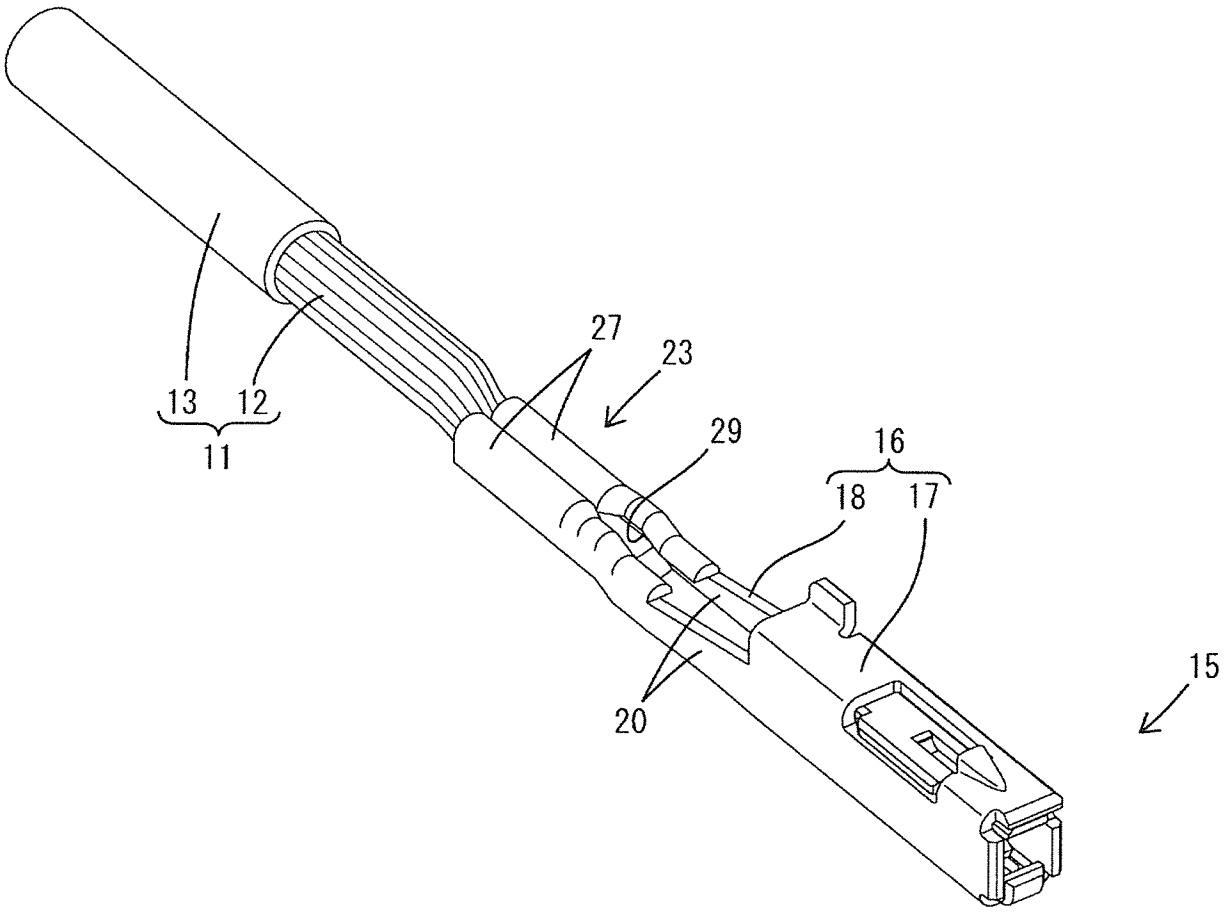
FIG. 7 is a perspective view showing a state before a mold portion is formed in the wire with terminal.
Figure 8:
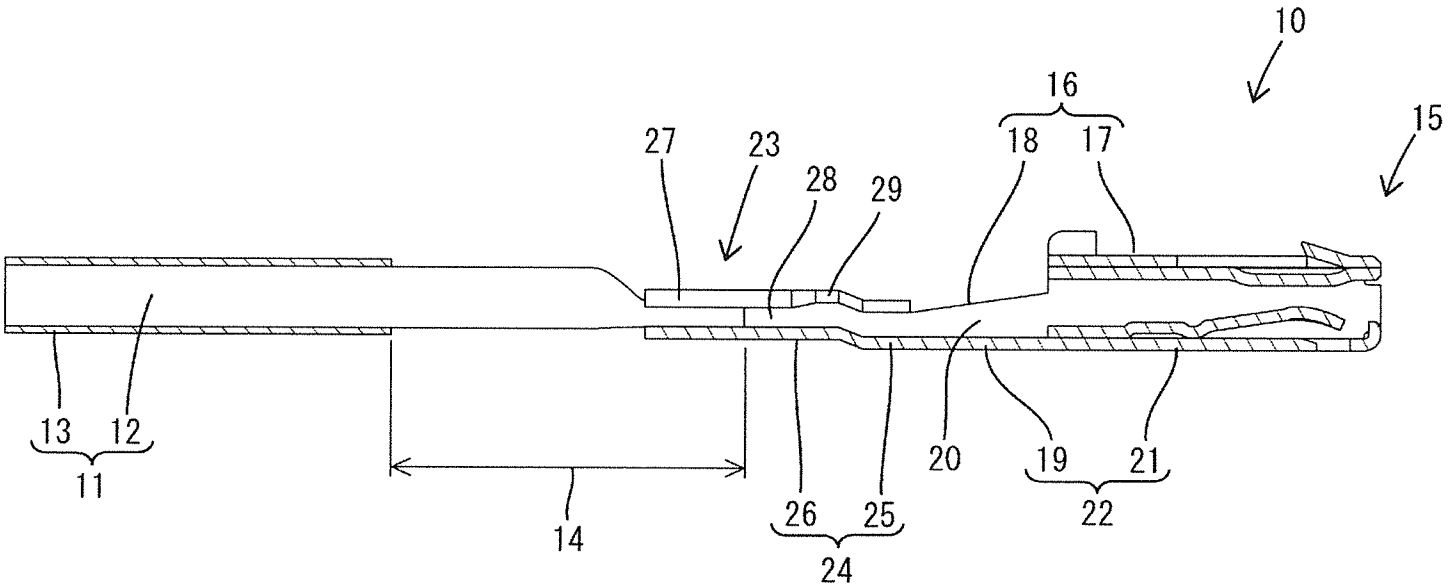
FIG. 8 is a section showing the state before the mold portion is formed in the wire with terminal.
Figure 9:
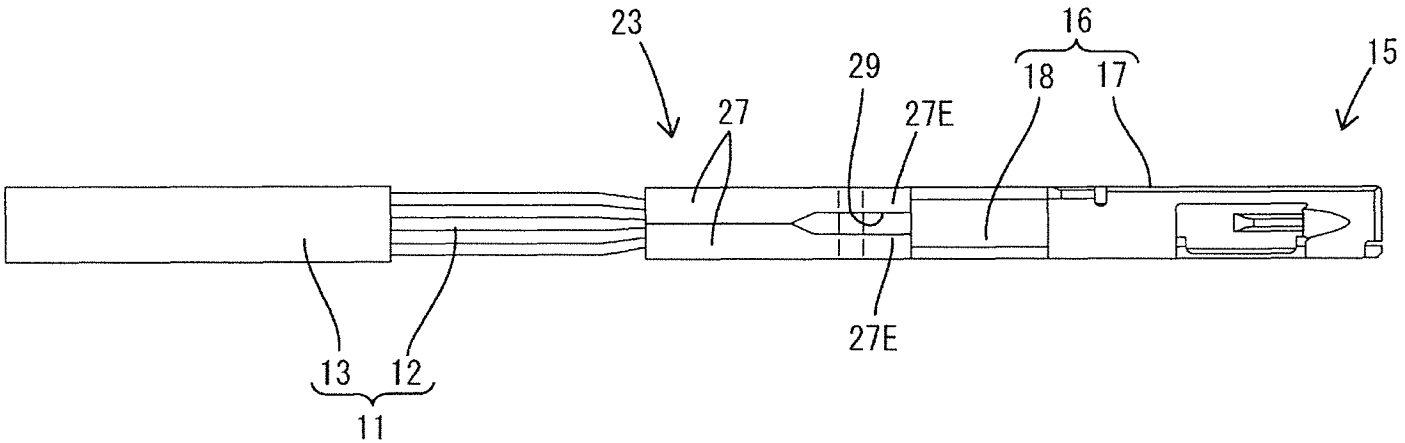
FIG. 9 is a plan view showing the state before the mold portion is formed in the wire with terminal.

The terminal fitting 15 is formed by applying bending and the like to a plate material made of copper or copper alloy stamped into a predetermined shape and shaped to be long and narrow in the front-rear direction. As shown in FIGS. 7 and 8, the terminal fitting 15 is composed of a terminal body 16 constituting a front end area of the terminal fitting 15 and a barrel 23 constituting a rear end area.

The terminal body 16 is composed of a box-shaped connecting portion 17 having a rectangular tube shape and a coupling 18 connected to the rear end of the box-shaped connecting portion 17. A tab of a mating male terminal (not shown) is inserted into the box-shaped connecting portion 17 from the front of the terminal fitting 15 to be connected. The coupling 18 is formed such that two side walls 20 rise from both left and right sides of a bottom wall 19. The bottom wall 19 of the coupling 18 is continuous and flush with a lower wall 21 of the box-shaped connecting portion 17, and the bottom wall 19 and the lower wall 21 constitute a base bottom 22 of the terminal body 16.

The barrel 23 is composed of a base plate 24 that is long and narrow in the front-rear direction and two crimping pieces 27 extending in a circumferential direction (direction intersecting a length direction of the terminal fitting 15) from both sides of the base plate 24 in a width direction. As shown in FIGS. 6 and 8, the base plate 24 is so bent that a front part thereof is lowered via a step. In this way, a lower plate portion 25 is formed in the front part of the base plate 24 and an area of the base plate 24 behind the lower plate portion 25 serves as a raised plate portion 26. A length of the raised plate portion 26 in the front-rear direction is longer than a dimension of the lower plate portion 25 in the front-rear direction. The lower plate portion 25 is continuous and flush with a rear end part of the base bottom 22 at the same height, and the raised plate portion 26 is raised with respect to the base bottom 22.

The barrel 23 is crimped to the front end part of the coated wire 11 (core 12) by an automatic machine (not shown) called an applicator. In a crimping process, the crimping pieces 27 are bent and deformed to surround the front end part of the core 12 placed on the rear part of the base plate 24 (raised plate portion 26). In this way, as shown in FIG. 8, a crimping space 28 surrounded by the base plate 24 and the crimping pieces 27 is formed inside the barrel 23. The front part of the core 12 and the terminal fitting 15 accommodated in this crimping space 28 are fixed conductively and 15 are connected substantially straight.

The core 12 is accommodated only in a rear end part of the crimping space 28 of the barrel 23, and a part of the mold 30 to be described later is filled in an area of the crimping space 28 before the core 12. The crimping space 28 of the bane 23 is narrow. Thus, a means for making molten resin (not shown) easily flow into the crimping space 28 in a molding process of the mold 30 is necessary. As shown in FIG. 8, a communicating portion 29 is formed in an area of the barrel 23 before the front end of the core 12 by widening an interval between extending end parts 27E of the crimping pieces 27. The crimping space 28 and the outer peripheral surface of the barrel 23 are allowed to communicate by the communicating portion 29. The communicating portion 29 is open in a widthwise central part of the upper surface of the barrel 23. Further, a width of an opening area of the communicating portion 29 in a plan view is substantially constant from a front end to a rear end.

The mold 30 is molded after the terminal fitting 15 is crimped to the core 12. The mold 30 is molded by accommodating the entire barrel 12, a rear end part of the coupling 18 and the front end part of the insulation coating 13 in the coated wire 11 into a known mold cavity (not shown), injecting molten resin (not shown) into the mold cavity and solidifying (curing) the injected molten resin. In the molding process, part of the molten resin flows into the crimping space 28 of the barrel 23 via the communicating portion 29.

As shown in FIG. 6, the mold 30 after molding surrounds the entire barrel 23, the entire exposed area 14 of the core 12 including the crimped part to the barrel 23 and a front end part of an area of the coated wire 11 where the insulation coating 13 remains over the entire periphery in a liquid-tight manner. Further, a part of the front area of the mold 30 is accommodated inside the coupling 18 before the barrel 23. The lower surface (outer surface) of a bottom area of the mold 30 covering the raised plate portion 26 of the barrel 23 is substantially at the same height as the lower surface (outer surface) of the base bottom 22 of the terminal body 16, specifically slightly higher than the lower surface of the base bottom 22.

As shown in FIG. 3, the wire with terminal 10 obtained by integrating the front part of the coated wire 11, the terminal fitting 15 and the mold 30 is inserted into a terminal accommodation chamber 36 from behind the housing 35. In an inserted state, the entire terminal fitting 15 and most of the exposed area 14 of the core 12, excluding the rear end part, are accommodated in the terminal accommodation chamber 36. Thus, an area of the coated wire 11 where the core 12 is surrounded by the insulation coating 13 is disposed entirely outside the terminal accommodation chamber 36 (housing 35).

An area of the mold 30 accommodated in the terminal accommodation chamber 36 and surrounding the entire terminal fitting 15 and the exposed area of the core 12 in a liquid-tight manner serves as an accommodating portion 31. An area of the mold 30 surrounding the rear end part of the exposed area 14 of the core 12 and the front end part of the insulation coating 13 in a liquid-tight manner behind and outside the terminal accommodation chamber 36 (housing 35) serves as a projection 32. The projection 32 of the mold 30 has a function of suppressing the influence of bending on the terminal fitting 15 when an area of the coated wire 11 behind the mold 30 is bent vertically.

Specifically, the projection 32 of the mold 30 is formed with upper and lower reinforcing portions 34 as a reinforcing means 33 for enhancing the vertical bending rigidity of the mold 30. The reinforcing portions 34 make a thickness of the insulation coating 13 on an upper surface side and a thickness of the insulation coating 13 on a lower surface side larger than a thickness of the accommodating portion 31 substantially over the entire length of a projecting area. That is, the height of the mold 30 is larger in the reinforcing portions 34 (projection 32) than in the accommodating portion 31. Note that a width of the reinforcing portions 34 (projection 32) is equal to that of the accommodating portion 31.

As described above, the connector A of this embodiment includes the housing 35 formed with the terminal accommodation chambers 36 and the wires with terminals 10 to be inserted into the respective terminal accommodation chambers 36. The wire with terminal 10 includes the coated wire 11, the terminal fitting 15 and the mold 30. The coated wire 11 includes the core 12 and the insulation coating 13 surrounding the core 12, and the core 12 is exposed in the front part of the coated wire 11. The barrel 23 is formed in the rear part of the terminal fitting 15 and is crimped to surround the exposed area 14 of the core 12 without contacting the insulation coating 13. Specifically, the barrel 23 is crimped to the front part of the coated wire 11.

The mold 30 covers the front part of the coated wire 11 (i.e. the entire exposed area 14 of the core 12 including the crimped part to the barrel 23 and the front end part of the insulation coating 13) in a liquid-tight manner. The core 12 is made of aluminum or aluminum alloy, whereas the terminal fitting 15 is made of copper or copper alloy. Thus, a contact part of the core 12 and the terminal fitting 15 (barrel 23) is surrounded in a liquid-tight manner by the mold 30 made of synthetic resin as an anti-corrosion means in the contact part of the core 12 and the terminal fitting 15 (barrel 23).

An outer diameter of the insulation coating 13 is larger than that of the core 12. Thus, an outer diameter of the area (projection 32) of the mold portion 30 surrounding the insulation coating 13 is larger than that of the area (accommodating portion 31) of the mold 30 surrounding the core 12. Accordingly, an insulation barrel to be crimped to surround the insulation coating 13 is not formed in the rear end part of the terminal fitting 15 constituting the wire with terminal 10 of this embodiment. The entire terminal fitting 15 and the front part of the mold 30 (i.e. only the area of the mold 30 before the front end of the insulation coating 13) are accommodated in the terminal accommodation chamber 36. However, the insulation coating 13 is not accommodated in the terminal accommodation chamber 36. This enables the entire area of the mold 30 surrounding the terminal fitting 15 to be accommodated in the terminal accommodation chamber 36 even without enlarging the volume (height and width) of the terminal accommodation chamber 36.

An insulation barrel, if present, would perform a function of suppressing the influence of bending of the coated wire 11 outside the housing 35 on the crimped part of the terminal fitting 15 and the core 12. However, the insulation barrel is not present in this embodiment. Thus, the mold 30 of this embodiment performs a waterproof function, and also performs the bending suppressing function that normally would be performed by the insulation barrel. Accordingly, the wire with terminal 10 of this embodiment is provided with the reinforcing portions 34 as the reinforcing means 33 for enhancing the rigidity of the projection 32 of the mold 30 projecting outward from the housing 35.

The reinforcing portions 34 make the vertical thickness of the projecting portion 32 of the mold 30 projecting out from the housing 35 larger than that of the accommodating portion 31 of the mold 30 accommodated in the terminal accommodation chamber 36. According to this configuration, the vertical bending rigidity of the projection 32 can be enhanced even without complicating the shape of the mold 30. Since the bending rigidity of the projection 32 of the mold 30 is enhanced in this way, the projection 32 is difficult to deform. In this way, the bending of the coated wire 11 does not affect the barrel 23 even if the coated wire 11 is bent behind the mold 30.

Further, the barrel 23 of the terminal fitting 15 includes the base plate portion 24 and the two crimping pieces 27. The base plate 24 is connected to the base bottom 22 of the terminal body 16 and the two crimping pieces 27 extend from the both widthwise sides of the base plate 24. The crimping pieces 27 of the barrel 23 are crimped and connected to surround the outer periphery of the core 12 placed on the base plate 24. This barrel 23 is surrounded over the entire periphery by the mold 30, but most of the terminal body 16 of the terminal fitting 15 before the barrel 23 is not covered by the mold 30. The entire terminal fitting 15 including the barrel 23 is accommodated in the terminal accommodation chamber 36 of the housing 35.

As described above, the mold 30 covers the base plate 24 of the barrel 23, but does not cover the base bottom 22 of the terminal body 16. Thus, a step may be formed between the outer surface of the base bottom 22 and the outer surface of the area of the mold 30 covering the barrel 23. If such a step is formed, a clearance is formed between the outer surface of the base plate 22 and the inner wall surface of the terminal accommodation chamber 36 when the terminal fitting 15 is accommodated into the terminal accommodation chamber 36. Thus, the posture of the terminal fitting 15 in the terminal accommodation chamber 36 may become unstable.

Accordingly, the base plate 24 of the barrel 23 is raised with respect to the base bottom 22 of the terminal body 16. According to this configuration, a height difference between the lower surface of the exposed base bottom 22 of the terminal body 16 and the lower surface of the area of the mold 30 surrounding the barrel 23 can be reduced or eliminated. Thus, even if an inner wall of the terminal accommodation chamber 36 has a flat shape, the terminal fitting 15 can be accommodated in a stable posture in the terminal accommodation chamber 36.

Further, the barrel 23 formed in the rear end part of the terminal fitting 15 includes the two crimping pieces 27 extending from the both widthwise sides of the base plate 24, and is crimped to surround the exposed area 14 of the core 12 with the extending end parts 27E of the crimping pieces 27 held close to each other. The entire exposed area 14 of the core 12 including the crimped part to the barrel 23 is covered by the mold 30 in a liquid-tight manner.

In the wire with terminal 10 of this embodiment, the front end of the exposed area 14 of the core 12 is disposed behind the front end of the crimping pieces 27. Thus, in the molding process of the mold 30, the reliability of an anti-corrosion function needs to be enhanced by causing the molten resin to flow into the crimping space 28 of the barrel 23 without leaving any clearance and covering the front end surface of the core 12 by the mold 30. However, since the opening on the front end of the crimping space 28 of the barrel 23 is narrow, there is a problem that the molten resin is difficult to flow into the crimping space 28.

Accordingly, in this embodiment, the barrel 23 is formed with the communicating portion 29 for causing the crimping space 28 of the barrel 23 to be open in the outer peripheral surface of the barrel 23 before the front end of the core 12. By forming such a communicating portion 29, the molten resin more easily flows into the crimping space 28 of the barrel 23 by passing through the communicating portion 29 when the mold 30 is molded. Further, since the communicating portion 29 is formed between the extending end parts 27E of the crimping pieces 27, the base plate 24 needs not be cut and the strength of the base plate 24 is not reduced.

The invention is not limited to the above described and illustrated embodiment. For example, the following embodiments also are included in the scope of the invention.

Although the core of the coated wire is made of aluminum or aluminum alloy in the above embodiment, the material of the core is not limited to aluminum or aluminum alloy and may be another metal such as copper or copper alloy.

Although the terminal fitting is made of copper or copper alloy in the above embodiment, the material of the terminal fitting is not limited to copper or copper alloy and may be another metal such as aluminum or aluminum alloy.

Although the terminal fitting is not formed with the insulation barrel to be crimped to the insulation coating in the above embodiment, the invention can be applied also when the terminal fitting is formed with the insulation barrel.

Although the insulation coating of the coated wire is not accommodated in the terminal accommodation chamber in the above embodiment, the front part of the insulation coating may be accommodated in the terminal accommodation chamber.

LIST OF REFERENCE SIGNS

10 . . . wire with terminal
11 . . . coated wire
12 . . . core
13 . . . insulation coating
14 . . . exposed area of core
15 . . . terminal fitting
23 . . . barrel
24 . . . base plate
27 . . . crimping piece

27E . . . extending end part of crimping piece
28 . . . crimping space of barrel
29 . . . communicating portion
30 . . . mold

The invention claimed is:

1. A wire with terminal, comprising:

a coated wire including a core having a front end and an insulation coating surrounding an area of the core spaced rearward from the front end of the core so that the insulation coating has a front end spaced rearward of the front end of the core;

a terminal fitting;

a barrel formed in a rear part of the terminal fitting such that two crimping pieces extend from both widthwise sides of a base plate, the barrel pieces having front and rear edges, the rear edges being positioned between the front end of the insulation coating and the front end of the core, and the front edges being forward of the front end of the core, the barrel being crimped so that the crimping pieces surround an exposed area of the core, with extending end parts of the crimping pieces that are adjacent the rear edges of the crimping pieces being held close to each other, the crimped barrel being formed with a communicating portion by widening an interval between extending end of the crimping pieces in an area before the front end of the core, the communicating portion being configured to cause a crimping space in the barrel to be open in an outer peripheral surface of the barrel; and a mold covering the front end of the insulation coating, the entire exposed area of the core and the entire crimped barrel in a liquid-tight manner.

2. A connector comprising a housing with a terminal accommodating chamber and the wire with terminal of claim 1, wherein:

the barrel is crimped to surround the exposed area of the core without contacting the insulation coating; and the entire terminal fitting and only an area of the mold before a front end of the insulation coating are accommodated in the terminal accommodation chamber formed in the housing.

* * * * *